US011732705B2

(12) United States Patent
Coppeta et al.

(10) Patent No.: US 11,732,705 B2
(45) Date of Patent: Aug. 22, 2023

(54) PUMPING STRUCTURE, PARTICLE DETECTOR AND METHOD FOR PUMPING

(71) Applicant: ams AG, Premstaetten (AT)

(72) Inventors: Raffaele Coppeta, Eindhoven (NL); Jacopo Brivio, Eindhoven (NL); Anderson Pires Singulani, Eindhoven (NL); Verena Vescoli, Eindhoven (NL)

(73) Assignee: AMS AG, Premstätten (AT)

( * ) Notice: Subject to any disclaimer, the term of this patent is extended or adjusted under 35 U.S.C. 154(b) by 0 days.

(21) Appl. No.: 16/967,828

(22) PCT Filed: Feb. 1, 2019

(86) PCT No.: PCT/EP2019/052534
§ 371 (c)(1),
(2) Date: Aug. 6, 2020

(87) PCT Pub. No.: WO2019/158377
PCT Pub. Date: Aug. 22, 2019

(65) Prior Publication Data

US 2021/0040943 A1 Feb. 11, 2021

(30) Foreign Application Priority Data

Feb. 16, 2018 (EP) ..... 18157175

(51) Int. Cl.
*F04B 43/02* (2006.01)
*F04B 43/04* (2006.01)

(52) U.S. Cl.
CPC ..... *F04B 43/026* (2013.01); *F04B 43/043* (2013.01); *F04B 43/046* (2013.01)

(58) Field of Classification Search
CPC .... F04B 43/026; F04B 43/043; F04B 43/046; F04B 43/02; G01N 2001/1427;
(Continued)

(56) References Cited

U.S. PATENT DOCUMENTS 5,097,835 A * 3/1992 Putz ..... A61B 5/24 600/377
5,836,750 A * 11/1998 Cabuz ..... F04B 43/0063 417/322

(Continued)

FOREIGN PATENT DOCUMENTS

AU 2008/363189 4/2010
CN 205003048 U 1/2016

(Continued)

OTHER PUBLICATIONS

European Patent Office, International Search Report for PCT/EP2019/052534 dated Apr. 1, 2019.

(Continued)

*Primary Examiner* — Philip E Stimpert
*Assistant Examiner* — Dnyanesh G Kasture
(74) *Attorney, Agent, or Firm* — MH2 Technology Law Group LLP

(57) ABSTRACT

A pumping structure comprises at least two membranes, at least two actuation chambers, one evaluation chamber comprising an opening to the outside of the pumping structure, and at least three electrodes. Each membrane is arranged between two electrodes in a vertical direction which is perpendicular to the main plane of extension of the pumping structure, each actuation chamber is arranged between one of the membranes and one of the electrodes in vertical direction, and each actuation chamber is connected to the evaluation chamber via a channel. Furthermore, a particle detector and a method for pumping are provided.

17 Claims, 7 Drawing Sheets

(58) Field of Classification Search
CPC ... G01N 2001/1454; G01N 2001/1436; G01N 15/0612; G01N 2015/0693; G01N 1/14; G01N 2001/1418–2001/149
USPC ..... 417/412, 413.1–413.3
See application file for complete search history.

(56) References Cited

U.S. PATENT DOCUMENTS

| | | | | |
|---|---|---|---|---|
| 6,116,863 | A | 9/2000 | Ahn et al. | |
| 6,261,066 | B1 | 7/2001 | Linnemann et al. | |
| 6,633,207 | B1 * | 10/2003 | Hidaka | H01P 7/082 333/204 |
| 7,005,078 | B2 | 2/2006 | Van Lintel et al. | |
| 7,175,258 | B2 | 2/2007 | Cabal et al. | |
| 7,284,966 | B2 | 10/2007 | Xu et al. | |
| 7,287,965 | B2 * | 10/2007 | Vogley | F04B 43/046 417/413.2 |
| 8,434,855 | B2 | 5/2013 | Huffman et al. | |
| 8,727,501 | B2 | 5/2014 | Xie et al. | |
| 8,864,287 | B2 | 10/2014 | Huffman et al. | |
| 2002/0098097 | A1 | 7/2002 | Singh | |
| 2003/0136178 | A1 * | 7/2003 | Cabuz | F04B 43/14 73/31.02 |
| 2003/0186462 | A1 * | 10/2003 | Zook | G01N 33/0011 422/561 |
| 2007/0014676 | A1 * | 1/2007 | Cabuz | F04B 43/043 417/413.3 |
| 2014/0109558 | A1 * | 4/2014 | Ganesan | F01N 13/0093 60/311 |
| 2016/0171869 | A1 * | 6/2016 | Gullbrand | H01L 23/4735 340/606 |
| 2018/0001640 | A1 * | 1/2018 | Eid | B41J 2/14298 |
| 2018/0258923 | A1 * | 9/2018 | Marsh | F04B 43/0045 |
| 2019/0178775 | A1 * | 6/2019 | Feng | G01N 27/62 |

FOREIGN PATENT DOCUMENTS

| | | |
|---|---|---|
| DE | 10 2006 028986 | 12/2007 |
| DE | 10 2007 045637 | 4/2009 |
| DE | 102015210919 | 12/2016 |
| WO | 02/057744 | 7/2002 |
| WO | 2014/014801 | 1/2014 |
| WO | 2016/202790 | 12/2016 |

OTHER PUBLICATIONS

Chinese First Office Action (with English Translation) in corresponding Chinese Application No. 201980013295.7 dated Jan. 17, 2022, 12 pages.

* cited by examiner

PUMPING STRUCTURE, PARTICLE DETECTOR AND METHOD FOR PUMPING

CROSS-REFERENCE TO RELATED APPLICATIONS

The present application is the national stage entry of International Patent Application No. PCT/EP2019/052534, filed on Feb. 1, 2019, which claims the benefit of priority of European Patent Application No. 18157175.3, filed on Feb. 16, 2018, all of which are hereby incorporated by reference in their entirety for all purposes.

BACKGROUND OF THE INVENTION

The present application relates to a pumping structure, a particle detector and a method for pumping.

A pumping structure can for example be employed in a particle detector. In order to detect particles in the environment of the particle detector the particles can be detected inside of the particle detector. Therefore, it is necessary to pump the particles for example into an evaluation chamber of the particle detector. Such a pumping structure might require valves and a high power consumption. However, for portable applications a small volume and a small power consumption of the pumping structure and the particle detector are advantageous.

SUMMARY OF THE INVENTION

This disclosure provides a pumping structure which can be operated efficiently. This disclosure further provides a particle detector which can be operated efficiently. This disclosure further provides an efficient method for pumping.

According to at least one embodiment of the pumping structure, the pumping structure comprises at least two membranes. The membranes can be micromechanical membranes. This means, the membranes can be microelectromechanical systems (MEMS). Furthermore, the membranes can each comprise an electrically conductive material. For example, the membranes can comprise poly-silicon. The membranes can comprise the shape of a square.

The pumping structure further comprises at least two actuation chambers. Each actuation chamber can comprise a first volume of gas. Each actuation chamber can be formed by suspending one membrane over walls surrounding the actuation chamber. This can mean, that each actuation chamber comprises a bottom side and a top side which faces away from the bottom side. At the top side of each actuation chamber one membrane can be arranged. The first volume of gas within the actuation chamber can be surrounded by walls which delimit the actuation chamber. Each of the membranes can be suspended over one actuation chamber. This means, each membrane can be attached to the walls surrounding the respective actuation chamber. The walls can comprise an electrically conductive material. For example, the walls can comprise poly-silicon.

The actuation chambers can be arranged next to each other in a lateral direction which is parallel to the main plane of extension of the pumping structure. The actuation chambers can be arranged adjacent to each other such that they are not in direct contact.

The pumping structure further comprises one evaluation chamber comprising an opening to the outside of the pumping structure. The evaluation chamber can comprise a second volume of gas. The second volume of gas can be in direct contact with the gas or air of the surrounding of the pumping structure via the opening. The evaluation chamber can be arranged below the actuation chambers in a vertical direction, where the vertical direction is perpendicular to the main plane of extension of the pumping structure.

The pumping structure further comprises at least three electrodes. Each electrode can comprise an electrically conductive material as for example a poly-silicon. Furthermore, each of the electrodes can extend parallel to the main plane of extension of the pumping structure. Within each actuation chamber one electrode can be arranged at the bottom side of the actuation chamber. The electrodes arranged within the actuation chambers are referred to as lower electrodes. One of the electrodes can be arranged outside of the actuation chambers. The electrode or electrodes arranged outside of the actuation chambers is or are referred to as upper electrode or upper electrodes.

Each electrode can be covered by an insulating layer. This can mean, that an insulating layer comprising an electrically insulating material can be arranged between each of the electrodes and one membrane. The electrodes can be in direct contact with the insulating layers. The membranes are optionally not in direct contact with the insulating layers if the membranes are not deflected. The insulating layers can have a thickness in vertical direction of at least 0.1 μm and at most 10 μm. For example, the insulating layers can comprise a dielectric material, as for example silicon nitride or silicon dioxide. The insulating layers can be thin films.

Each membrane is arranged between two electrodes in a vertical direction which is perpendicular to the main plane of extension of the pumping structure. This means, for each membrane one lower electrode is arranged at the bottom side of the respective actuation chamber. Furthermore, for each membrane one upper electrode is arranged at a side of the respective membrane which faces away from the actuation chamber. It is possible, that the pumping structure comprises one upper electrode which is arranged at the side of both membranes which faces away from the actuation chambers. This means, the membranes can share one upper electrode.

Each actuation chamber is arranged between one of the membranes and one of the electrodes in vertical direction. This means that at the top side of each actuation chamber one membrane is arranged and at the bottom side of each actuation chamber one electrode is arranged.

Each actuation chamber is connected to the evaluation chamber via a channel. This means, the first volume of gas within each actuation chamber can be direct contact with the second volume of gas within evaluation chamber via the channel. The channel can for example be arranged at the bottom side of each actuation chamber. The channels can be permeable for gases and fluids. The channel can be arranged at a top side of the evaluation chamber, where the top side of the evaluation chamber faces away from the side where the opening is arranged.

The pumping structure can be arranged to pump particles, this means gases and/or fluids. A flow of particles can be created from the actuation chambers through the evaluation chamber.

In order to create a flow of particles the membranes are deflected. In order to deflect the membranes a voltage can be applied to the upper electrode or the upper electrodes. This means, a potential difference exists between the upper electrode and the membrane for each actuation chamber. The applied voltage can be set in such a way that the membrane is deflected in the direction of the upper electrode. This means, the membrane can move in the direction of the upper electrode. In this way, the volume of the actuation chamber is increased. In a next step, a voltage can be applied to the lower electrode arranged at the bottom side of the actuation chamber for each actuation chamber. In this way, the membrane can be deflected or towards the lower electrode. As the volume of the actuation chamber is decreased by a movement of the membrane towards the lower electrode gases or fluids from within the actuation chamber are pumped out of the actuation chamber through the channel. The voltages can be applied to the electrodes in such a way that the at least two membranes move simultaneously. Therefore, a flow of particles from the actuation chambers through the evaluation chamber can be created. The gases, fluids or particles which are pumped out of the actuation chambers can be pumped out of the evaluation chamber through the opening.

The voltages applied to the electrodes can be controlled by an integrated circuit of the pumping structure. Consequently, no external circuit is required.

Advantageously, the pumping structure described herein can be manufactured as a microelectromechanical system which is small enough in size such that it can be incorporated in a portable device, for example a smartphone. Furthermore, the power consumption of the pumping structure can be small enough such that it can be operated in a portable device. In addition, the pumping structure can be operated efficiently. Because of the geometric arrangement of the actuation chambers and the evaluation chamber a laminar or unidirectional flow can be achieved within the evaluation chamber. In this way, the evaluation chamber can be emptied efficiently. For example, the evaluation chamber can be emptied in less than one second. This can mean, that a volume of gas or fluids within the evaluation chamber can be replaced by gas or fluids from the activation chambers within less than one second.

Moreover, stiction of the membranes to one of the electrodes is avoided as the membranes are arranged between two electrodes in vertical direction.

According to at least one embodiment of the pumping structure, the channels extend parallel to a main direction of extension of the evaluation chamber. The main direction of extension of the evaluation chamber can be parallel to the vertical direction. It is further possible that the main direction of extension of the evaluation chamber is not parallel to the vertical direction. The main direction of extension of the evaluation chamber can be parallel or approximately parallel to a direction of a flow of particles from the channels towards the opening. This means, the channels and the opening are arranged in such a way that gases, fluids or particles can flow unidirectionally from the channels to the opening. The channels extend parallel to the main direction of extension of the evaluation chamber in order to establish a unidirectional flow during pumping. In this way, the pumping structure can be operated efficiently.

According to at least one embodiment of the pumping structure, the evaluation chamber has a symmetry axis which is parallel to a main direction of extension of the evaluation chamber and the actuation chambers are arranged axisymmetrically with respect to the symmetry axis of the evaluation chamber. The evaluation chamber can be axisymmetric with respect to its symmetry axis. It is further possible that the evaluation chamber is axisymmetric with respect to its symmetry axis within a cross section. This means, at least one cross section exists within which the evaluation chamber has a symmetry axis. That the actuation chambers are axisymmetrically with respect to the symmetry axis of the evaluation chamber can mean, that the actuation chambers are axisymmetrically within at least one cross section. At least one symmetry axis of the evaluation chamber exists, for which the actuation chambers are arranged axisymmetrically. Because of the symmetric arrangement of the actuation chambers a unidirectional flow of particles can be achieved within the evaluation chamber during pumping. In this way, the pumping structure can be operated efficiently.

According to at least one embodiment of the pumping structure, each actuation chamber comprises a pumping volume given by the difference between the volume of the respective actuation chamber for the case that the membrane is not deflected and the volume of the respective actuation chamber for the case that the membrane is fully deflected. Each membrane can be deflected by applying a voltage between the membrane and one of the electrodes. In this way, an electrostatic force can be induced which moves the membrane towards one of the electrodes. For example, each membrane can be deflected towards the upper electrode. In this case, the volume of the respective actuation chamber is increased. It is further possible that each membrane is deflected towards the respective lower electrode. In this case, the volume of the respective actuation chamber is decreased. The membranes are not deflected if no voltage is applied to the electrodes. In this case, the membranes can extend parallel to the main plane of extension of the pumping structure. The membranes can be fully deflected in the case that the membranes are in direct contact with one of the electrodes. It is further possible that the membranes are fully deflected in the case that the membranes are in direct contact with one insulating layer which is arranged between the membrane and one of the electrodes. It is further possible that the membranes are not in direct contact with one of the electrodes or the insulating layer when they are fully deflected.

By decreasing the volume of the actuation chamber gases or fluids can be pumped out of the actuation chamber towards the evaluation chamber. The pumping volume refers to the volume of gases or fluids which can be pumped out of the respective actuation chamber by a deflection of the membrane. Therefore, the pumping volume refers to the difference between the volume of the actuation chamber with a non-deflected membrane and the volume of the actuation chamber with a fully deflected membrane.

As each actuation chamber comprises a pumping volume, the gases, fluids or particles within the evaluation chamber can be pumped out of the evaluation chamber.

According to at least one embodiment of the pumping structure, the volume of the evaluation chamber equals the summed pumping volumes of the actuation chambers. This means for example, that two pumping volumes together equal the volume of the evaluation chamber. Consequently, the total volume that can be pumped by the pumping structure equals the volume of the evaluation chamber. Therefore, by deflecting the membranes of the actuation chambers the total amount of gases, fluids or particles within the evaluation chamber can be pumped out of the evaluation chamber. By deflecting the membranes of the actuation chambers in the opposite direction, this means towards the upper electrode, gases, fluids or particles from the environment of the pumping structure can be pumped into the evaluation chamber. Therefore, the pumping structure can be employed in a particle detector. The gases or fluids within the evaluation chamber can be efficiently pumped out of the evaluation chamber.

According to at least one embodiment of the pumping structure, the pumping structure is configured to pump gases. The pumping structure can be configured to pump gases out of the evaluation chamber. For example the pumping structure can be configured to pump air. It is further possible, that the pumping structure is configured to pump gases comprising particles such as dust or pollen. Advantageously, the pumping structure can be employed in a particle detector which is arranged to detect particles within the gas.

According to at least one embodiment of the pumping structure, the membranes comprise an electrically conductive material. The membranes can for example comprise poly-silicon. In order to deflect the membranes by applying a voltage between the membranes and the electrodes, it is necessary that the membranes comprise an electrically conductive material. In this way, an electrostatic force can be induced which moves the membranes towards one of the electrodes. The deflection of the membranes enables that gases, fluids or particles can be pumped out of the evaluation chamber.

According to at least one embodiment of the pumping structure, the pumping structure is free of valves. This can mean, that the activation chambers are directly connected with the evaluation chamber via the channels. No valves are arranged between the activation chambers and the evaluation chamber. Furthermore, the evaluation chamber can be directly connected to the environment of the pumping structure via the opening. No valve is arranged within the opening. Advantageously, as no valves are required, the setup of the pumping structure can be simple. Therefore, the production of the pumping structure is less complicated and the pumping structure can be more stable as it is free of valves which can be damaged during operation.

Furthermore, a particle detector is provided. The particle detector comprises the pumping structure described herein. This means all features disclosed for the pumping structure are also disclosed for the particle detector. The particle detector can be arranged to detect particles from the environment of the particle detector. For example the particle detector can be arranged to detect particles within gases or fluids.

According to at least one embodiment of the particle detector, a light source is arranged within the evaluation chamber. The light source can for example be a light emitting diode or a laser, as for example a vertical-cavity surface-emitting laser. The light source can be arranged at a side of the evaluation chamber facing away from the opening. The light source can be arranged to emit electromagnetic radiation during operation of the particle detector.

According to at least one embodiment of the particle detector, a photodetector is arranged within the evaluation chamber. The photodetector can be arranged at the side of the evaluation chamber where the opening is arranged. The photodetector can comprise an array of photodetectors. The photodetector can be arranged to detect electromagnetic radiation. For example, the photodetector can be arranged to detect electromagnetic radiation emitted by the light source.

According to at least one embodiment of the particle detector, the particle detector is configured to detect particles within the evaluation chamber. The electromagnetic radiation emitted by the light source can be absorbed or reflected at particles present in the evaluation chamber. By detecting the electromagnetic radiation reaching the side of the evaluation chamber where the photodetector is arranged, for example the number of particles within the evaluation chamber can be determined. It is further possible that other parameters of gases or fluids within the evaluation chamber are determined.

As the particle detector comprises the pumping structure, gases and/or fluids from the outside of the particle detector can be pumped into the evaluation chamber and out of the evaluation chamber. In this way, particles from the environment of the particle detector can be detected. The faster the pumping structure can empty the evaluation chamber the faster the particle detector can detect changes in the gas or the fluid in the environment of the particle detector. Furthermore, a method for pumping is provided. The method for pumping can optionally be performed by using a pumping structure or a particle detector described herein. This means all features disclosed for the pumping structure or the particle detector are also disclosed for the method for pumping and vice-versa.

According to at least one embodiment of the method for pumping, the method comprises the step of providing at least two actuation chambers, which are each arranged between a membrane and a lower electrode. The actuation chambers can be arranged between the membrane and the lower electrode in a vertical direction, where the vertical direction is perpendicular to the main plane of extension of the membranes.

The method for pumping further comprises the step of providing one evaluation chamber comprising an opening to the outside of the evaluation chamber.

The method for pumping further comprises the step of providing at least one upper electrode such that each membrane is arranged between one lower electrode and one upper electrode in the vertical direction. It is further possible that two upper electrodes are provided such that each membrane is arranged between one lower electrode and one upper electrode in the vertical direction.

The method for pumping further comprises the step of applying a voltage to the lower electrodes simultaneously. The voltage can be applied between the membranes and the lower electrodes. By applying a voltage to the lower electrodes the membranes are deflected. For example, the membranes can be deflected in the direction of the lower electrodes. By deflecting the membranes, the volume of the actuation chambers can be decreased. Therefore, gases or fluids are pumped from the actuation chambers towards the evaluation chamber. As the voltage is applied to the lower electrodes simultaneously a unidirectional flow of particles can be created within the evaluation chamber. In this way, gases or fluids can be pumped out of the evaluation chamber in an efficient way.

The method for pumping further comprises the step of applying a voltage to the at least one upper electrode, wherein each actuation chamber is connected to the evaluation chamber via a channel. The voltage can be applied between the at least one upper electrode and the membranes such that a voltage is applied between each membrane and the at least one upper electrode. By applying a voltage to the upper electrode the membranes are deflected. For example, the membranes can be deflected in the direction of the upper electrode. By deflecting the membranes, the volume of the actuation chambers can be increased. Therefore, gases or fluids can be pumped from the evaluation chamber into the actuation chambers. Furthermore, gases or fluids from the environment of the evaluation chamber can be pumped into the evaluation chamber. In this way, gases or fluids from the environment of the evaluation chamber can be analyzed in the evaluation chamber. Moreover, the gases and/or fluids from the environment of the evaluation chamber can be pumped efficiently into the evaluation chamber.

Advantageously, the method for pumping enables a unidirectional flow of gases or fluids within the evaluation chamber. In this way, the evaluation chamber can be pumped efficiently. Furthermore, no valves are required in order to pump the evaluation chamber which allows a simpler setup for pumping.

According to at least one embodiment of the method for pumping, the voltage applied to the electrodes is set in such a way that the membrane is deflected when the voltage is applied to the respective electrode. For example the membrane can be deflected towards the respective electrode. By applying a voltage between the membrane and one of the electrodes, an electrostatic force can be induced which moves the membrane towards one of the electrodes.

According to at least one embodiment of the method for pumping, alternatingly a voltage is applied to the lower electrodes simultaneously and to the at least one upper electrode. This can mean, that in a first step a voltage is applied to the lower electrodes simultaneously. Consequently, the membranes are deflected towards the lower electrodes. In a next step, a voltage is applied to the at least one upper electrode. Thus, the membranes are deflected towards the at least one upper electrode. These two steps can be repeated alternatingly. In this way, gases and/or fluids are pumped out of the evaluation chamber and out of the actuation chambers in an efficient way.

BRIEF DESCRIPTION OF THE DRAWINGS

The following description of figures may further illustrate and explain exemplary embodiments. Components that are functionally identical or have an identical effect are denoted by identical references. Identical or effectively identical components might be described only with respect to the figures where they occur first. Their description is not necessarily repeated in successive figures.

In FIGS. 2A, 2B and 2C top views on an exemplary embodiment of a particle detector with a pumping structure are shown.

Figure 3A:
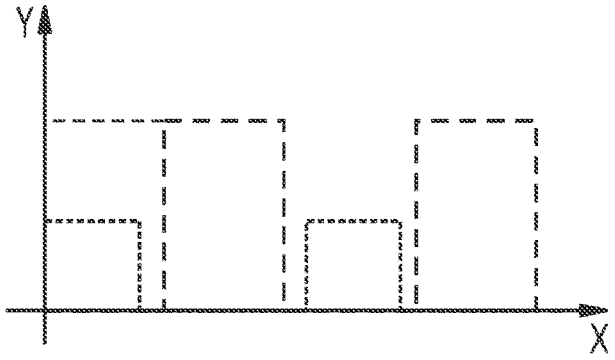
Figure 3B:
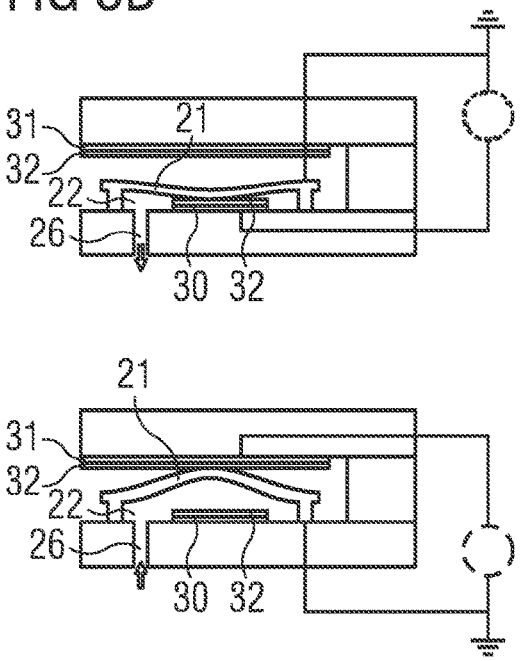

With FIGS. 3A and 3B an exemplary embodiment of the method for pumping is described.

With FIGS. 4, 5, 6, 7A and 7B simulation results for the particle flow in an exemplary embodiment of a particle detector with a pumping structure are shown.

With FIGS. 8A, 8B, 8C, 8D and 9 the setup of an exemplary embodiment of a particle detector with a pumping structure is described.

Figure 10:
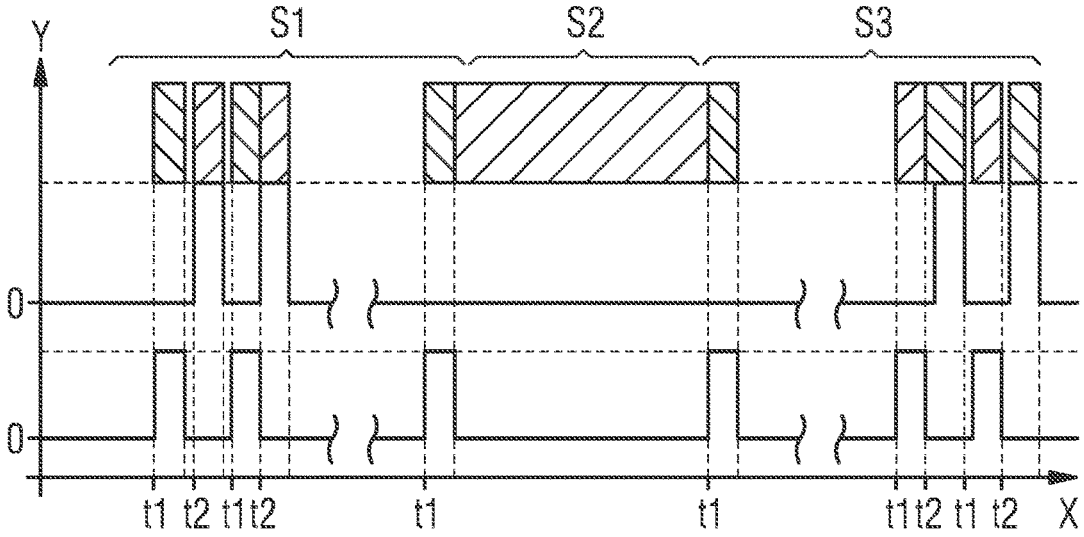

With FIG. 10 an exemplary embodiment of the method for pumping is described.

DETAILED DESCRIPTION

Figure 1:
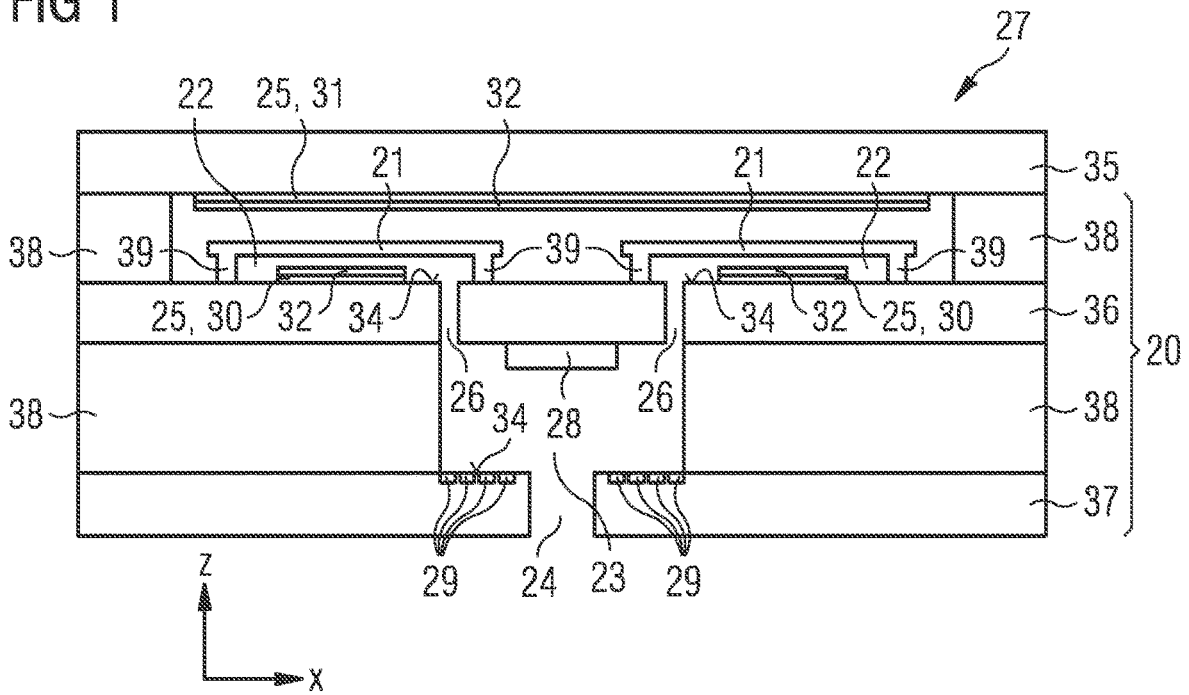
In FIG. 1 a cutaway view of an exemplary embodiment of a particle detector with a pumping structure is shown.

In FIG. 1 a cutaway view of an embodiment of a particle detector 27 comprising a pumping structure 20 is shown. The pumping structure 20 comprises two actuation chambers 22 and one evaluation chamber 23. Each actuation chamber 22 is formed by a membrane 21 which is suspended over walls 39. The membranes 21 comprise an electrically conductive material. The walls 39 delimit the actuation chamber 22 in lateral directions x, y which are parallel to the main plane of extension of the pumping structure 20. The actuation chambers 22 are arranged on a first substrate 36. At a bottom side 34 of the actuation chambers 22, which faces away from the membrane 21, an electrode 25 is arranged. The first substrate 36 can comprise a semiconductor material, as for example silicon. Furthermore, the first substrate 36 can comprise an integrated circuit. On the side of the electrodes 25 which faces away from the first substrate 36 an insulating layer 32 is arranged. In this way, each actuation chamber 22 comprises a first volume of gas and it is delimited by the membrane 21, the walls 39 and the first substrate 36. At the bottom side 34 of each actuation chamber 22 a channel 26 is arranged. The channels 26 directly connect the actuation chambers 22 with the evaluation chamber 23.

The evaluation chamber 23 comprises an opening 24 to the outside of the pumping structure 20. The opening 24 is arranged within a second substrate 37. The second substrate 37 is arranged at a bottom side 34 of the evaluation chamber 23, where the bottom side 34 of the evaluation chamber 23 faces away from the channels 26. The second substrate 37 is connected with the first substrate 36 via spacers 38. The spacers 38 can for example be polystyrene spheres incorporated in a medium or dispended on the second substrate 37.

The channels 26 extend parallel to a main direction of extension of the evaluation chamber 23. The main direction of extension of the evaluation chamber 23 is parallel to a vertical direction z which is perpendicular to the main plane of extension of the pumping structure 20. Furthermore, the evaluation chamber 23 has a symmetry axis which is parallel to the main direction of extension of the evaluation chamber 23 and the actuation chambers 22 are arranged axisymmetrically with respect to the symmetry axis of the evaluation chamber 23. The symmetry axis of the evaluation chamber 23 is parallel to the vertical direction z and runs through the opening 24. Thus, on both sides of this symmetry axis one actuation chamber 22 is arranged.

The pumping structure 20 further comprises a third electrode 25 which is arranged at the side of the membranes 21 which faces away from the actuation chambers 22. The electrodes 25 arranged on the first substrate 36 are referred to as lower electrodes 30. The electrode 25 which is arranged at the side of the membranes 21 which faces away from the activation chambers 22 is referred to as upper electrode 31. The upper electrode 31 is attached to a covering body 35. The covering body 35 extends parallel to the main plane of extension of the first substrate 36 and of the second substrate 37. The covering body 35 is attached to the first substrate 36 via spacers 38. On top of the upper electrode 31 an insulating layer 32 is arranged, such that the insulating layer 32 is arranged between the upper electrode 31 and the membranes 21. If the membranes 21 are not deflected, they are not in direct contact with either the insulating layers 32 nor with the electrodes 25.

This means, each membrane 21 is arranged between two electrodes 25 in the vertical direction z. Furthermore, each actuation chamber 22 is arranged between one of the membranes 21 and one of the electrodes 25 in vertical direction z.

Advantageously, the pumping structure 20 is free of valves. The actuation chambers 22 are directly connected with the evaluation chamber 23 via the channels 26.

The particle detector 27 further comprises a light source 28 which is arranged within the evaluation chamber 23. The light source 28 can for example be a light emitting diode or a laser. The light source 28 is arranged at a top side 33 of the evaluation chamber 23, where the top side 33 faces away from the opening 24. The light source 28 is arranged to emit electromagnetic radiation during operation of the particle detector 27.

The particle detector 27 further comprises a photodetector 29 which is arranged within the evaluation chamber 23. The photodetector 29 comprises a plurality of photodetectors 29. The plurality of photodetectors 29 is arranged at the bottom side 34 of the evaluation chamber 23. In this way, the particle detector 27 is configured to detect particles within the evaluation chamber 23.

Figure 2A:
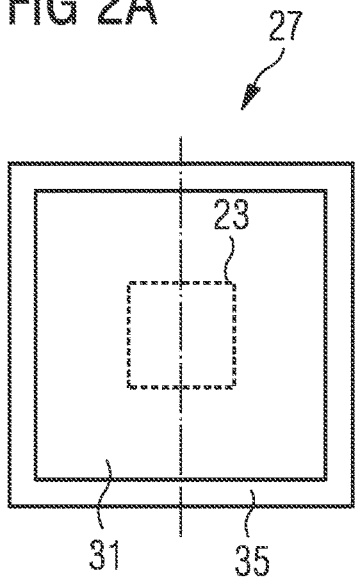

With FIGS. 2A, 2B and 2C top views on an exemplary embodiment of the particle detector 27 with the pumping structure 20 are shown for different vertical positions. In FIG. 2A the upper electrode 31 and the size of the evaluation chamber 23 are shown. The dashed line marks the cross section shown in FIG. 1.

Figure 2B:
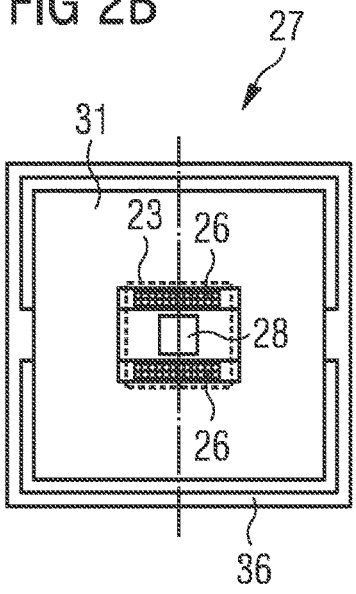

In FIG. 2B the upper electrode 31 above the two membranes 21 is shown. Furthermore, the two channels 26 and the light source 28 are shown.

Figure 2C:
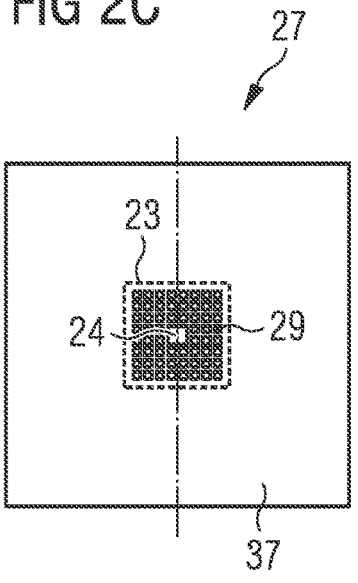

In FIG. 2C the photodetectors 29, the second substrate 37 and the opening 24 are shown.

FIG. 3A the voltages applied to one of the membranes 21 are plotted. On the x-axis the time is plotted in arbitrary units and on the y-axis the voltage is plotted in arbitrary units. At first, a voltage is applied which moves the membrane 21 towards the lower electrode 30. In a next step, a higher voltage is applied in order to move the membrane 21 towards the upper electrode 31. These two steps can be repeated alternatingly.

With FIG. 3B it is shown where the voltages are applied. A cutaway view of one of the actuation chambers 22 is shown with a schematic circuit diagram. In the upper case, which corresponds to the first step shown in FIG. 3A, a voltage is applied between the membrane 21 and the lower electrode 30. Therefore, the volume of the actuation chamber 22 is decreased and gases or fluids within the actuation chamber 22 are moved out of the actuation chamber 22 through the channel 26. In the lower case, which corresponds to the second step shown in FIG. 3A, a voltage is applied between the membrane 21 and the upper electrode 31. Therefore, the volume of the actuation chamber 22 is increased and gas or fluids are pumped from the evaluation chamber 23 through the channel 26 to the actuation chamber 22. Each actuation chamber 22 comprises a pumping volume given by the difference between the volume of the respective actuation chamber 22 for the case that the membrane 21 is not deflected and the volume of the respective actuation chamber 22 for the case that the membrane 21 is fully deflected. The pumping volume is the volume of gas and/or fluid which can be pumped out of each actuation chamber 22.

Figure 4:
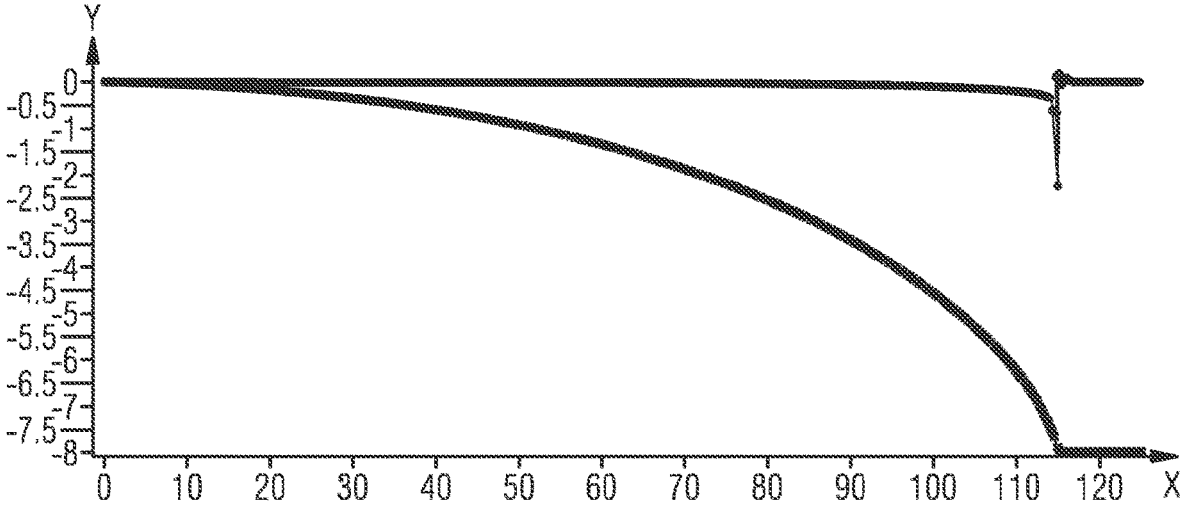

In FIG. 4 simulations of the movement of the membrane 21 of an exemplary embodiment of the pumping structure 20 are shown. On the x-axis the time is plotted in μs. The lower line shows the displacement of the membrane 21 in vertical direction z in μm. The upper line shows the velocity of the membrane 21 in vertical direction z in m/s. At 0 μs the membrane 21 is in direct contact with the insulating layer 32 which is arranged on the upper electrode 31. At 0 μs a voltage of 10 V is applied between the membrane 21 and the lower electrode 30. Therefore, the membrane 21 is deflected towards the lower electrode 30. At approximately 115 μs the membrane 21 is in direct contact with the insulating layer 32 which is arranged on the lower electrode 30. The displacement of the membrane 21 in vertical direction z amounts to 8 μm. The velocity of the membrane 21 in vertical direction z increases with increasing displacement in vertical direction z. If voltages smaller than 10 V are applied between the membrane 21 and the lower electrode 30 the time required for the membrane 21 to reach the insulating layer 32 which is arranged on the lower electrode 30 is increased.

Figure 5:
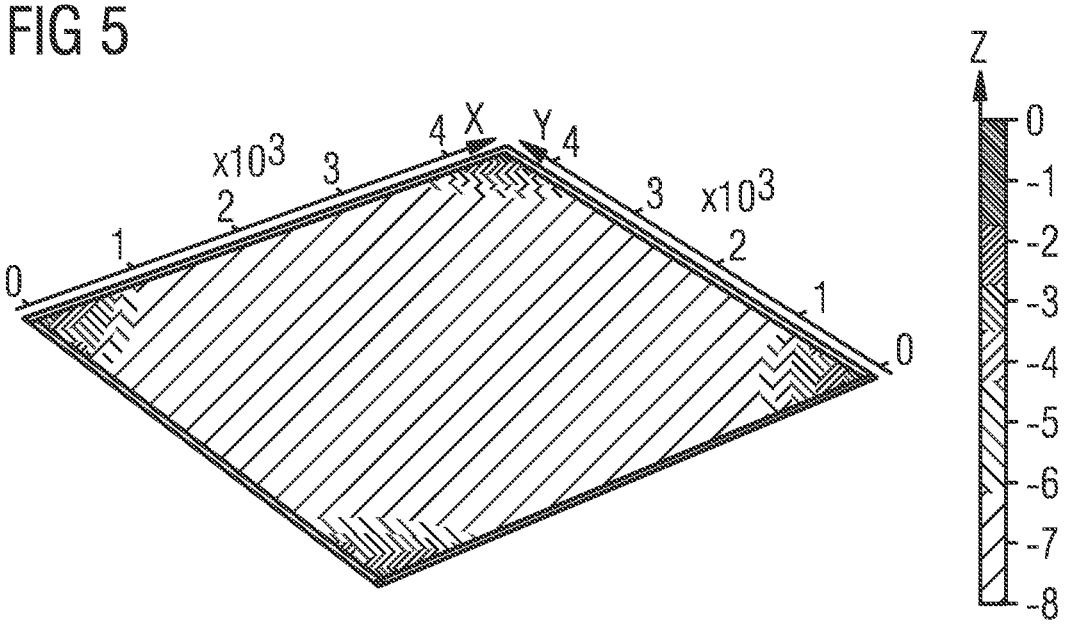

In FIG. 5 a simulation of the displacement of a fully deflected membrane 21 is shown. On the x-axis and on the y-axis the extension of the membrane 21 in lateral directions x, y is given in mm. On the z-axis the displacement of the membrane 21 in vertical direction z is plotted in μm. Most of the membrane 21 is in direct contact with the insulating layer 32 which is arranged on the lower electrode 30.

Figure 6:
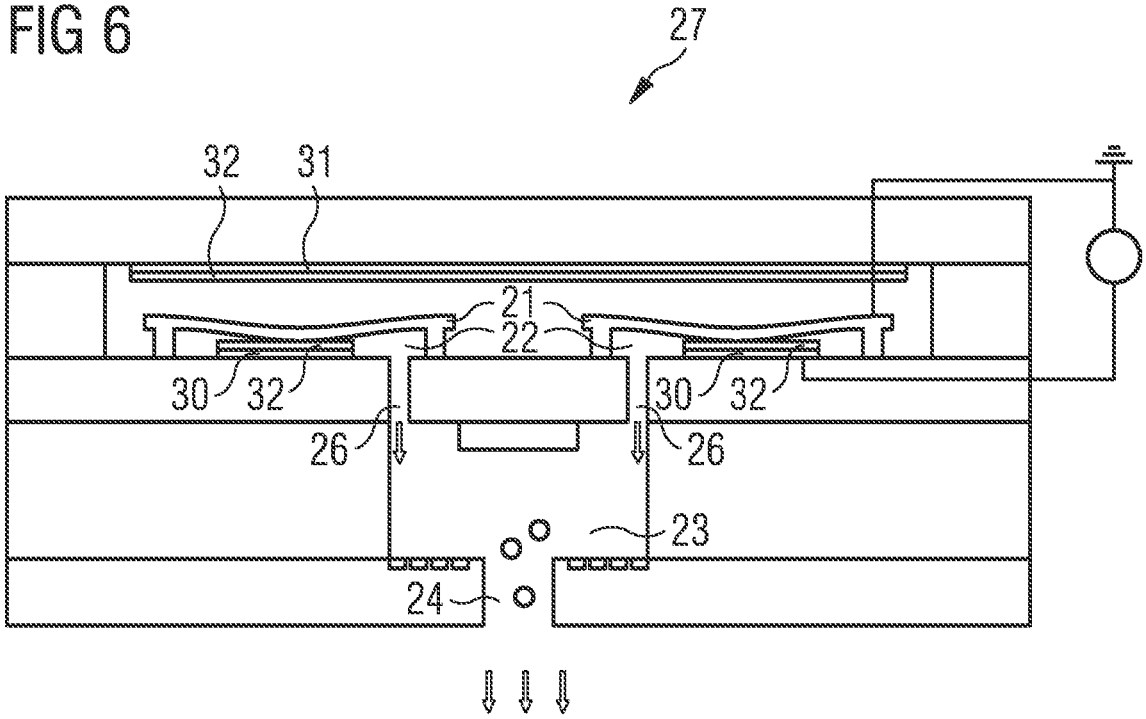

In FIG. 6 the flow of particles is shown schematically for the setup of the pumping structure 20 shown in FIG. 1. It is further shown schematically, that a voltage is applied between the membranes 21 and the respective lower electrode 30. Therefore, the membranes 21 are deflected towards the lower electrodes 30. The gas and/or fluid within the actuation chambers 22 is pumped through the channels 26 because of the movement of the membranes 21. Within the evaluation chamber 23 a unidirectional flow of the gas and/or the fluid is established. The gas and/or the fluid can comprise particles, as for example dust or pollen which is schematically shown in FIG. 6. The flow of the gas and/or fluid is directed towards the opening 24. The gas and/or fluid which is arranged within the evaluation chamber 23 is pumped out of the evaluation chamber 23 through the opening 24. As the volume of the evaluation chamber 23 equals the summed pumping volumes of the actuation chambers 22, the volume of gas and/or fluid within the evaluation chamber 23 can be pumped out of the pumping structure 20 completely.

Figure 7A:
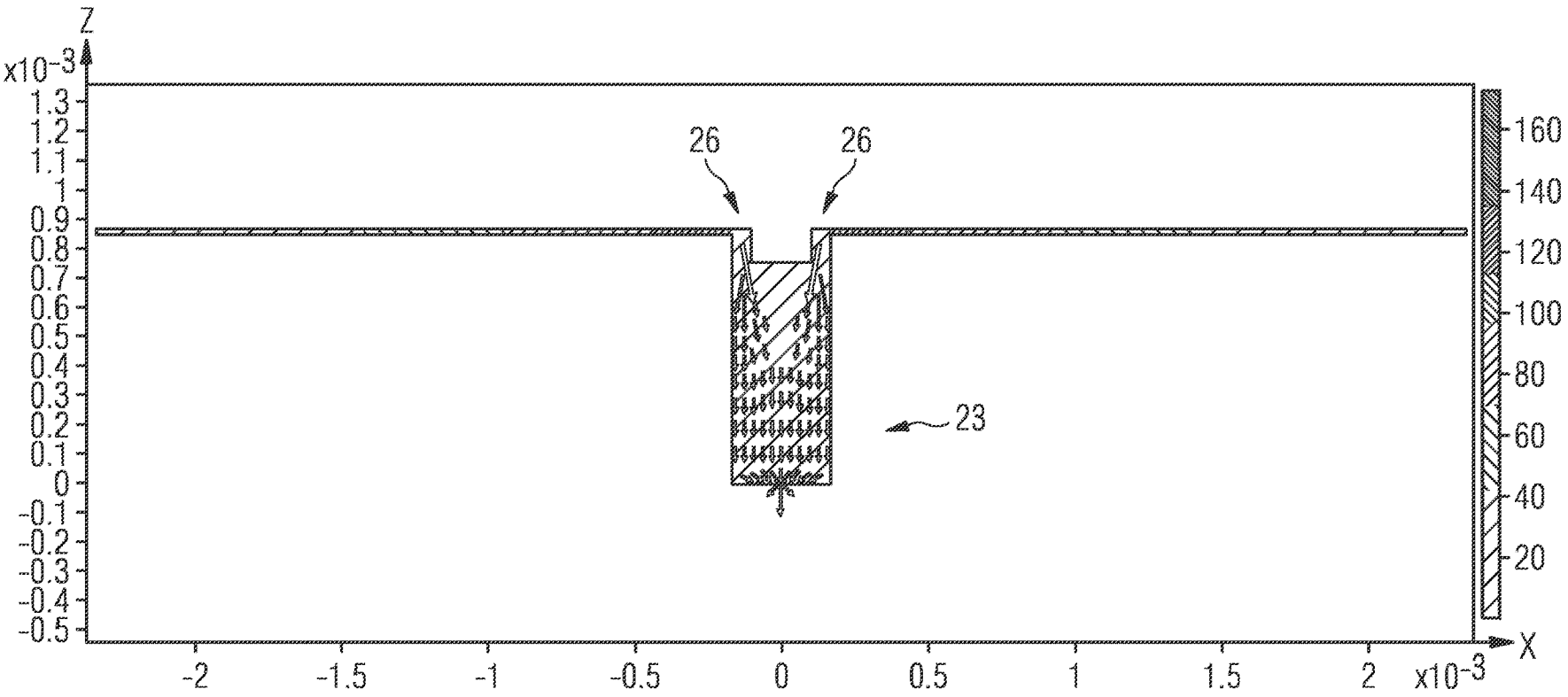

FIG. 7A shows a simulation of the flow of gas within the evaluation chamber 23. On the x-axis the extent in the lateral direction x is plotted in mm. On the z-axis the extent in vertical direction z is plotted in mm. Gases and/or fluids from the actuation chambers 22 enter the evaluation chamber 23 through the channels 26. The arrows symbolize the flow of the gas and/or fluid. The size of each arrow is proportional to the magnitude of the velocity of the gas and/or fluid at their respective position. The larger the arrow, the larger is the velocity of the gas and/or fluid. Furthermore, the scale bar on the right side relates to the velocity of the gas and/or fluid in m/s. The direction of each arrow corresponds to the direction of the flow of gas and/or fluid. The flow rate of the gas and/or fluid can for example amount to 200 $mm^3/s$.

Figure 7B:
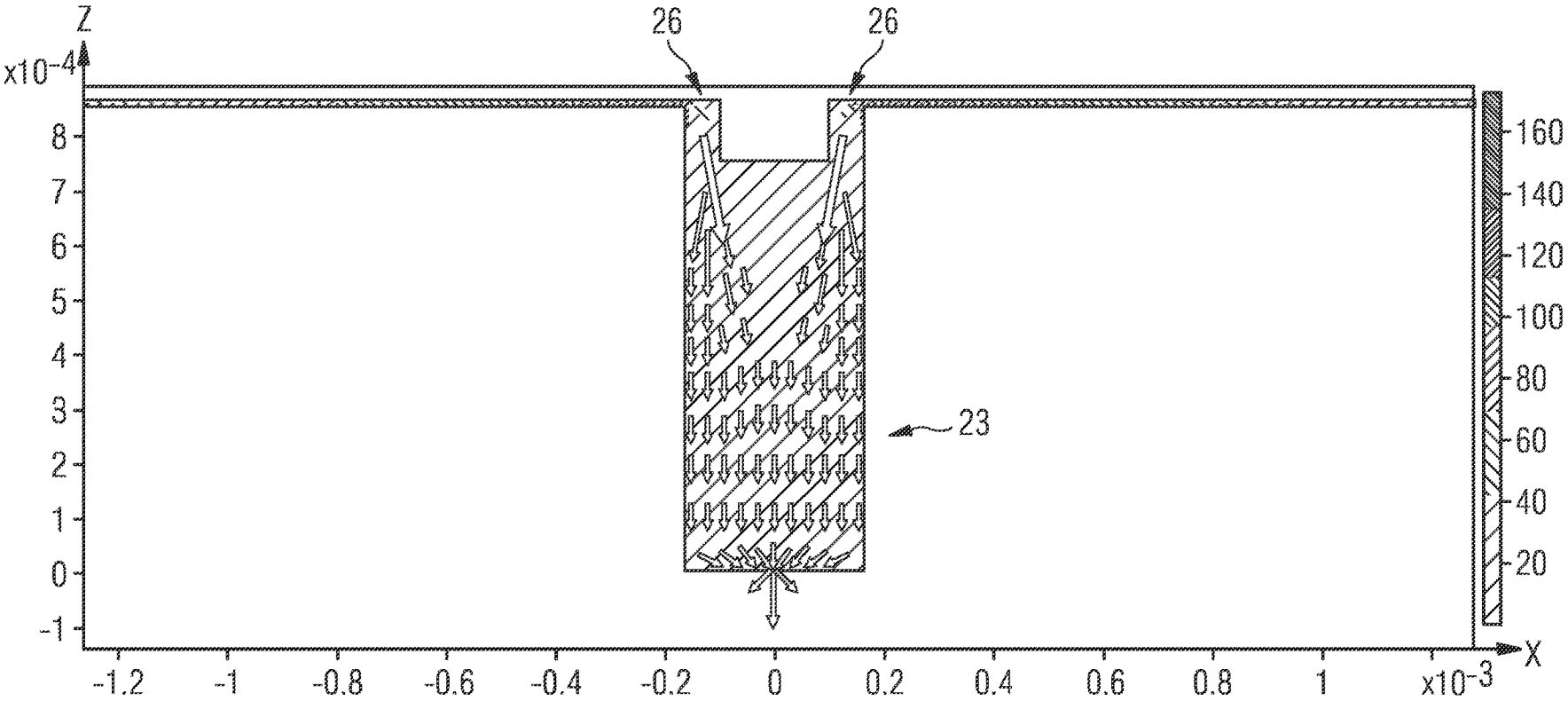

In FIG. 7B an enlarged view of the plot shown in FIG. 7A is depicted. Within the evaluation chamber 23 the arrows run parallel. This means, that the flow of gas and/or fluid is laminar. Therefore, all the gas and/or fluid is directed to flow in the same direction towards the opening 24.

Figure 8A:
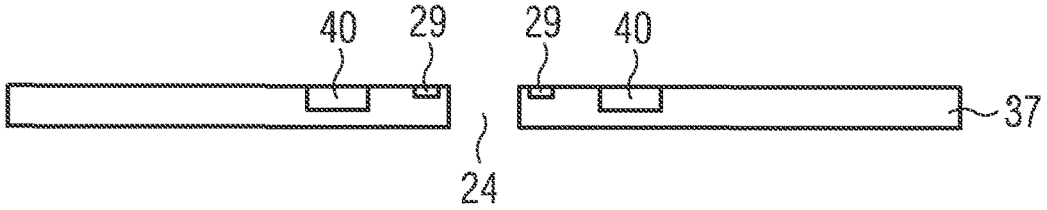

With FIGS. 8A, 8B, 8C and 8D the setup of an exemplary embodiment of a particle detector 27 with a pumping structure 20 is described. The particle detector 27 with the pumping structure 20 can be produced as described in the following. In FIG. 8A the second substrate 37 is shown which comprises the opening 24. The opening 24 can be formed by micro fabrication techniques as for example deep ion etching. The second substrate 37 can comprise silicon. Within the second substrate 37 the photodetectors 29 and integrated circuits 40 are formed. The integrated circuits 40 can for example be employed to control the photodetectors 29.

Figure 8B:
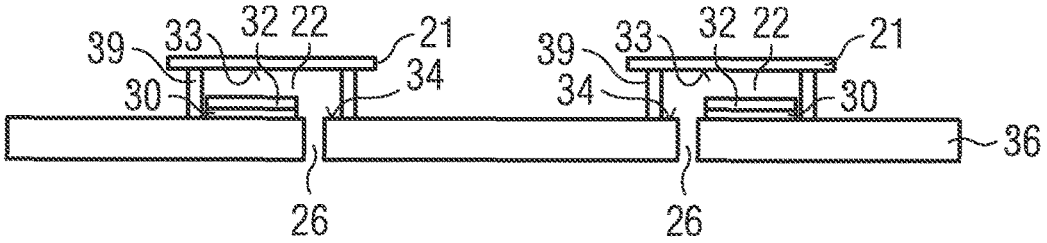

In FIG. 8B the first substrate 36 is shown. The first substrate 36 can comprise silicon. Two channels 26 are formed within the first substrate 36 by micro fabrication techniques. On top of the first substrate 36 microelectromechanical systems are formed which form the actuation chambers 22. Walls 39 are formed on the first substrate 36. Two membranes 21 are suspended over the walls 39 such that two actuation chambers 22 comprising each a volume of gas are formed. Each actuation chamber 22 comprises a top side 33 where the membrane 21 is arranged and a bottom side 34 where one of the channels 26 is arranged. Furthermore, at the bottom side 34 of each actuation chamber 22 a lower electrode 30 is arranged on the first substrate 36. On the lower electrode 30 an insulating layer 32 is arranged, such that the lower electrode 30 is arranged between the insulating layer 32 and the first substrate 36. Consequently, each actuation chamber 22 is delimited by one membrane 21, walls 39, the first substrate 36 and the insulation layer 32.

Figure 8C:
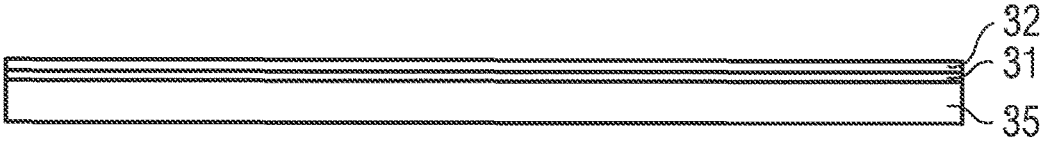

In FIG. 8C the covering body 35 is shown. On the covering body 35 the upper electrode 31 is arranged and on the upper electrode 31 the insulating layer 32 is arranged. The upper electrode 31 is arranged between the covering body 35 and the insulating layer 32. The covering body 35 can comprise silicon. The upper electrode 31 can be a thin metal layer.

Figure 8D:
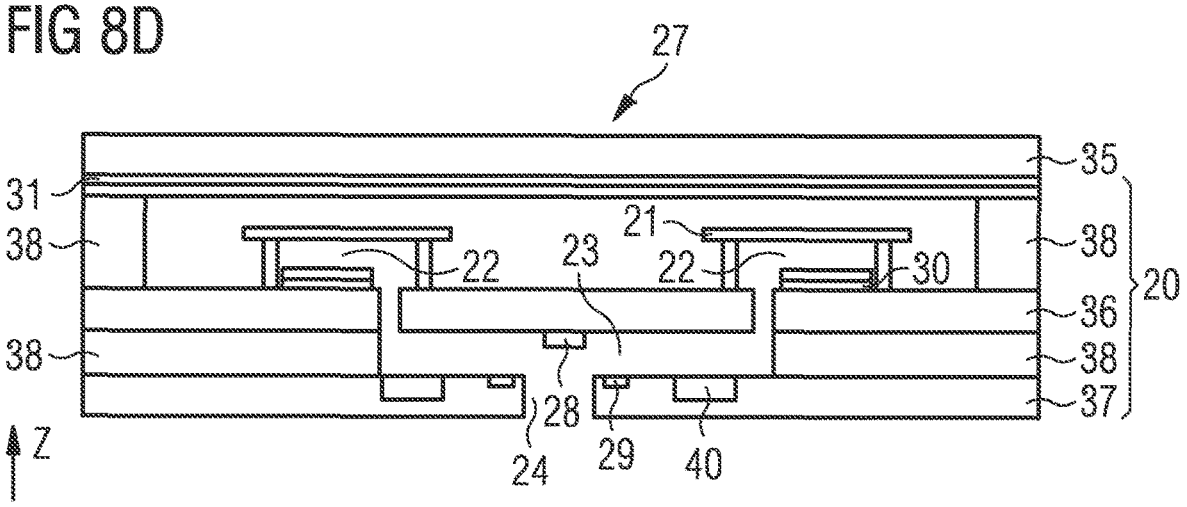

In FIG. 8D it is shown that the particle detector 27 with the pumping structure 20 is obtained by arranging the parts shown in FIGS. 8A, 8B and 8C on top of each other. A cross section through the particle detector 27 is shown. The first substrate 36 with the actuation chambers 22 is arranged between the second substrate 37 and the covering body 35 in vertical direction z. The second substrate 37 and the first substrate 36 are connected with each other via spacers 38. The first substrate 36 and the covering body 35 are connected with each other via spacers 38 as well. The distances between the first substrate 36, the second substrate 37 and the covering body 35 can be controlled via the thickness of the spacers 38, respectively. Furthermore, the light source 28 is arranged within the evaluation chamber 23 which is formed between the first substrate 36 and the second substrate 37.

Figure 9:
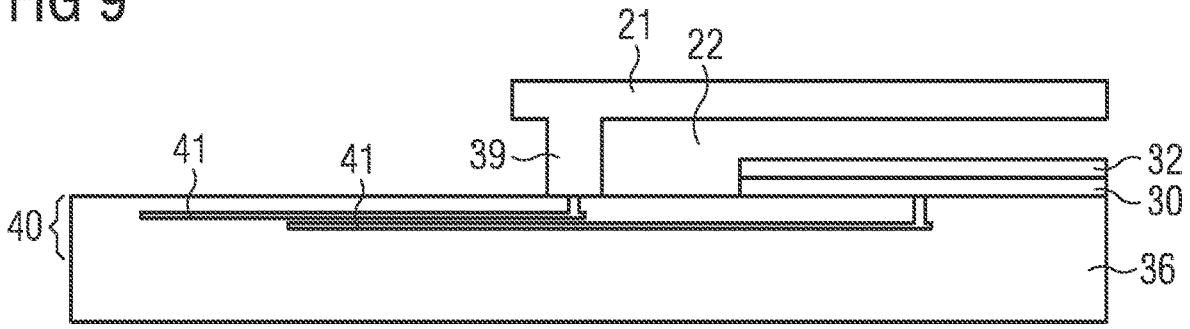

In FIG. 9 a section of an exemplary embodiment of the pumping structure 20 is shown in detail. A part of one actuation chamber 22 with the membrane 21 and the lower electrode 30 are shown. Via an integrated circuit 40 which is arranged within the first substrate 36 both the lower electrodes 30 and the membrane 21 can be electrically contacted. Therefore, electrical connections 41 are arranged within the first substrate 36. The electrical connections 41 comprise an electrically conductive material.

With FIG. 10 an exemplary embodiment of the method for pumping is described. On the x-axis the time is plotted in arbitrary units and on the y-axis the voltage is plotted in arbitrary units. The bottom line plotted on the y-axis corresponds to the voltage applied to the lower electrodes 30. The top line plotted on the y-axis corresponds to the voltage applied to the upper electrode 31.

In a first step S1 of the method for pumping gases and/or fluids are pumped out of the evaluation chamber 23. Therefore, at a time t1 a voltage is applied to the lower electrodes 30 simultaneously. Consequently, the membranes 21 are deflected towards the lower electrodes 30 such that the membranes 21 are in direct contact with the insulating layers 32 which are arranged on the lower electrodes 30. Gases and/or fluids are pumped out of the actuation chambers 22 towards the evaluation chamber 23. Gases and/or fluids within the evaluation chamber 23 are pumped out of the evaluation chamber 23 through the opening 24. At a time t2 a voltage is applied to the upper electrode 31. Consequently, the membranes 21 are deflected towards the upper electrode 31 such that the membranes 21 are in direct contact with the insulating layer 32 which is arranged on the upper electrode 31. Gases and/or fluids are pumped from the evaluation chamber 23 towards the actuation chambers 22 through the channels 26 because of the increased volume of the actuation chambers 22. Furthermore, gases and/or fluids from the environment of the pumping structure 20 are pumped in the evaluation chamber 23. At next, at a time t1 a voltage is applied to the lower electrodes 30 simultaneously again.

Therefore, the membranes 21 are again deflected towards the lower electrodes 30. During the first step S1 alternatingly a voltage is applied to the lower electrodes 30 simultaneously and to the upper electrode 31. Thus, the membranes 21 are deflected up and down in vertical direction z during pumping. In this way, gases and/or fluids from the environment of the pumping structure 20 or the particle detector 27 are pumped into the evaluation chamber 23. The number of cycles of the membranes 21 moving up and down can be adapted.

In a second step S2 at least one property of the gases and/or fluids within the evaluation chamber 23 is measured. During the second step no voltage is applied to the lower electrodes 30 and the upper electrode 31. For example the number of particles within the evaluation chamber 23 is determined during the second step.

In a third step S3 gases and/or fluids are pumped out of the evaluation chamber 23 again as described for the first step S1.

The invention claimed is:

1. A pumping structure comprising:

at least two membranes, at least two actuation chambers, and one evaluation chamber comprising an opening to an outside of the pumping structure, wherein within each actuation chamber, one lower electrode is arranged at a bottom side of the actuation chamber;

the pumping structure comprises one upper electrode which is arranged at a side of said least two membranes which faces away from said least two actuation chambers;

each of the at least two membranes is arranged between said one lower electrode and said one upper electrode in a vertical direction which is perpendicular to a pumping surface of the at least two membranes;

each of the at least two actuation chambers is directly connected to the one evaluation chamber via a channel, the channel being arranged at a side of the evaluation chamber that faces away from a side where the opening is arranged, wherein said one upper electrode is configured to exert a force on said at least two membranes.

2. The pumping structure according to claim 1, wherein the channels extend parallel to a main direction of extension of the evaluation chamber.

3. The pumping structure according to claim 1, wherein the evaluation chamber has a symmetry axis which is parallel to a main direction of extension of the evaluation chamber and the actuation chambers are arranged axisymmetrically with respect to the symmetry axis of the evaluation chamber.

4. The pumping structure according to claim 1, wherein each actuation chamber comprises a pumping volume given by the difference between the volume of the respective actuation chamber for the case that the membranes are not deflected and the volume of the respective actuation chamber for the case that the membranes are fully deflected.

5. The pumping structure according to claim 4, wherein the volume of the evaluation chamber equals the summed pumping volumes of the actuation chambers.

6. The pumping structure according to claim 1, wherein the pumping structure is configured to pump gases.

7. The pumping structure according to claim 1, wherein the membranes comprise an electrically conductive material.

8. The pumping structure according to claim 1, wherein the pumping structure is free of valves.

9. A particle detector comprising the pumping structure according to claim 1.

10. The particle detector according to claim 9, wherein a light source is arranged within the evaluation chamber.

11. The particle detector according to claim 9, wherein a photodetector is arranged within the evaluation chamber.

12. The particle detector according to claim 9, which is configured to detect particles within the evaluation chamber.

13. The pumping structure according to claim 1, wherein the evaluation chamber is arranged below the at least two actuation chambers in the vertical direction.

14. The pumping structure according to claim 1, wherein the channel between each of the at least two actuation chambers and the evaluation chamber is the only opening of the respective actuation chamber.

15. A method for pumping, the method comprising:

providing at least two membranes, providing at least two actuation chambers, which are each arranged between one of the at least two membranes and a respective lower electrode, providing one evaluation chamber comprising an opening to an outside of the evaluation chamber, providing one upper electrode which is arranged at a side of said at least two membranes which faces away from said at least two actuation chambers such that each of the at least two membranes is arranged between said respective lower electrode and said one upper electrode in a vertical direction which is perpendicular to a pumping surface of the at least two membranes;

applying a voltage to the lower electrodes simultaneously, and applying a voltage to said upper electrode, wherein each actuation chamber is directly connected to the evaluation chamber via a channel, the channel being arranged at a side of the evaluation chamber that faces away from a side where the opening is arranged, wherein said one upper electrode is configured to exert a force on said at least two membranes.

16. The method according to claim 15, wherein the voltage applied is set in such a way that the membranes are deflected when the voltage is applied to a respective electrode.

17. The method according to claim 15, wherein voltage application is alternated between the lower electrodes simultaneously and said upper electrode.

* * * * *